US006053798A

United States Patent [19]

Tang

[11] Patent Number: 6,053,798

[45] Date of Patent: Apr. 25, 2000

[54] STRUCTURAL IMPROVEMENT OF TOY CHRISTMAS TREE

[76] Inventor: Tai-Ning Tang, 1 Fl. No.25, Alley 17, Lane 12, Pated Rd., Sec. 3, Taipei, Taiwan

[21] Appl. No.: 09/140,660

[22] Filed: Aug. 26, 1998

[51] Int. Cl.[7] ..... A63H 3/28

[52] U.S. Cl. ..... 446/301; 446/300; 446/342

[58] Field of Search ..... 40/416, 425; 446/300, 446/301, 303, 337, 342, 343, 347, 353, 175

[56] References Cited

U.S. PATENT DOCUMENTS

| | | | |
|---|---|---|---|
| 754,825 | 3/1904 | Spencer et al. . | |
| 4,721,437 | 1/1988 | Mitamura et al. | 446/301 |
| 4,805,328 | 2/1989 | Mirahem | 446/301 |
| 4,900,289 | 2/1990 | May et al. | 446/342 |
| 5,855,502 | 1/1999 | Truchsess | 446/301 |

FOREIGN PATENT DOCUMENTS

| | | | |
|---|---|---|---|
| 316488 | 9/1997 | Taiwan . | |
| 2198363 | 6/1988 | United Kingdom | 446/301 |

*Primary Examiner*—Kien T. Nguyen
*Assistant Examiner*—Jeffrey D. Carlson
*Attorney, Agent, or Firm*—Rabin & Champagne, P.C.

[57] ABSTRACT

A structural improvement of toy Christmas tree, involving mainly a foundation unit that is installed on top of a base to accommodate the entire mechanism of the invention, on the side of the lower part of the foundation unit is installed a motor which intermittent off-and-on rotation is controlled by a control circuit board installed in the base, the motor being linked with a reduction gear and a spring to drive a toy lower jaw part at the lower part of the foundation unit, and a driving rod to activate a toy eyebrow part that is located at the upper part of the foundation unit, thereby, once the power of the invention is switched on, the control circuit board will play happy music and flash LED light (the lamps being installed in the eyeball part), while the motor will drive the eyebrows and mouth of the Christmas tree to flip up and down and open and close, to create a fun image, meanwhile, its construction more simplified than conventional models will enable effective reduction of costs and enhancement of performance.

4 Claims, 4 Drawing Sheets

STRUCTURAL IMPROVEMENT OF TOY CHRISTMAS TREE

BACKGROUND OF THE INVENTION

This invention relates to a structural improvement of a toy Christmas tree, particularly to one with blinking eyes and a singing mouth with the accompaniment of music.

With the development of global data processing, cultural and religious exchanges, and mass media, Christmas has become a happy season that is shared by all peoples around the world. For the sake of a happy time, Christmas trees are seen everywhere in all types of building. Conventionally, real trees or artificial trees are decorated. On the trees are flashing lights and all types of small decorative items. Such conventional Christmas trees are static decorations that lack variability and dynamic atmosphere. Therefore, some manufacturers have come up with modifications on the main unit of the Christmas tree that, in addition to the existing function of static decoration, include intermittent swaying of the branches. A conventional construction has been disclosed in Patent No. 316488 "Toy Christmas Tree" (see Annex 1) published in the Patent Gazette in Taiwan, which includes a transmission mechanism installed inside a Christmas tree, to enable movement of the tree body; said patent is mainly composed of a tree body (10) in which is the installation of a number of batteries, a set of fixing seats (20) on the upper part of the tree body (10), several sets of upper and lower driving devices (30)(40) installed in the fixing seats (20), eye part (50) and lower jaw part (60) that are respectively driven by the upper and lower driving devices (30)(40), and branches and leaves (70) covering the fixing seats(20); the upper driving device (30) installed on the upper part in the fixing seat (20) is composed of a driving motor (31) capable of simple harmonic motion, a reduction gear set (32) that is linked to the driving motor (31) and a set of shafts (33) fitted to the reduction gear set (32); while the lower driving device (40) is composed of a driving motor (41) capable of simple harmonic motion, a reduction gear set (42) that is linked to the driving motor (41) and a set of shafts (43) fitted to the reduction gear set (42); two eye parts (50) respectively having a mobile upper eyelid (51) and an eyeball (52), on one side of the upper eyelid (51) is a joining seat (511) that can be joined with the shaft (33); the lower jaw part (60) having a U-shaped plate, on the bottom side on two insides at the rear of said plate is a joining plate (60) that can be joined with the shaft (43); said patented product is so operated that after the power is switched on, two driving motors (31)(41) will, in simple harmonic motion and via the reduction gear set (32)(42) and the shafts (33)(43), respectively drive the upper eyelid (51) and the lower jaw part (60) to swing up and down, so the Christmas tree looks like a human face with blinking eyes and a singing mouth. However, in the construction of said patent to enable the swinging of the upper eyelid and lower jaw part, two driving motors (31)(41) are respectively driven by two reduction gear sets (32)(42), which involves the following shortcomings:

1 It requires the assembly of two driving motors and respectively linked reduction gear sets, which involve sophisticated construction, high costs and complicated assembly and production processes.

2 As required for the transmission of two sets of motor, its power consumption is quite amazing, so the consumers would find it uneconomical.

3 In addition to the huge consumption of power under the circumstance of sophisticated transmission mechanism, its trouble rate is increased accordingly.

SUMMARY OF THE INVENTION

In view of the above shortcomings in conventional toy Christmas trees due to their unsatisfactory structural design, the inventor has devoted in the research, based on many years experience in the R&D and production of all sorts of toys, accompanied by repeated sample tests and amendments, and has successfully developed a "structural improvement of toy Christmas tree", which product has been satisfactorily tested to demonstrate excellent performance, employing only one motor in a transmission mechanism to smoothly drive the eyebrows and lower jaw part to blink and open and close its mouth, to effectively reduce production costs, save power, extend its service life and lower its trouble rate.

To enable better understanding of the structural characteristics and actual performance of this invention, the embodiment of this invention is described in details with drawings for your reference.

DETAILED DESCRIPTION OF PREFERRED EMBODIMENT

Please refer to FIGS. 1 through 4, this invention involves primarily a foundation unit 20 installed on top of a base 10 to accommodate the entire mechanism of the invention. To the outside of the foundation 20 can be attached by branches and leaves 60 to constitute the exterior of a Christmas tree, wherein, inside the base 10 can be installed a number of batteries, a power switch and a control circuit board. On said control circuit board are chips of dozens of recorded Christmas carols, the sound signal pulses transmitted from the chips serving to control the motor 31 to rotate and the control circuit to flash the LED. Since said circuit is not included in the characteristics of the subject matter, it is not elaborated here. The structural characteristics of this invention include the following:

Transmission device 30: installed at the lower part of the foundation unit 20, including a motor 31 that is located at one side of the foundation unit 20 and its rotation is controlled by the control circuit board, a reduction gear 32 that is located at the lower part inside the foundation unit 20 and is toothed with and driven by the shaft of the motor, a pushing rod 33 located eccentrically at the side of said reduction gear 32, and a spring 34 that is located at the bottom part inside the foundation unit 20 and is linked with the pushing rod 33.

Lower jaw part 40: located at the front of the lower part of the foundation unit 20, including a jaw plate 41 which extends to the front of the foundation unit 20 and to which edge can be attached with leaves, to the bottom part of the jaw plate 41 is fixed a support plate 42, the middle section of said support plate 42 serving as a hinge, to the edge of the plate body in front of the hinge is fitted with the jaw plate 41, to the plate body at the rear of the hinge is a slide channel 43, said slide channel 43 to be penetrated by the pushing rod 33 of said reduction gear 32 to drive it.

Eyebrow part 50: located at the front edge at the upper part of the foundation unit 20, including two eyeballs 51 that are respectively fitted at two sides of the foundation unit 20, and an eyebrow rod 52 which is fitted with an L-plate 53 to the upper part inside the foundation unit 20, to which can be adhered with leaves to look like eyebrows, said eyebrow rod 52 is linked to the front edge at the end of the L-plate 53, the other end of the L-plate 53 being linked to a driving rod 54, said driving rod 54 being linked to and driven by the pushing rod 33 of said reduction gear 32. One feature that should be mentioned is that, inside the two eyeballs 51 can be respectively installed with LED 55 which illumination is controlled by the control circuit in the base 10, for an additional touch of fun.

With the aforementioned structure, the entire appearance of the invention looks like another Christmas tree before its power is activated. To operate it, the power switch installed in the base 10 is turned on, then the control circuit will activate the chips to send off Christmas carols, and the LED 55 installed in the eyeballs 51 to flash on and off, meanwhile the sound signal pulses will drive the motor 31 to repeat on-and-off rotation along with the rhythm of the music, when the motor 31 is rotating, it drives the reduction gear 32 to rotate, then the pushing rod 33 drives the jaw plate 41 of the lower jaw part 40 to drop down, and the driving rod 54 drives the eyebrow rod 52 of the eyebrow part 50 to flip up, as illustrated in FIG. 3, while said jaw plate 41 drops down and the eyebrow rod 52 flips up, the spring 34 will accumulate a retracting resiliency while it is stretched by the pushing rod 33; when the motor 30 is controlled by the control circuit to switch off its rotation, the spring 34 will retract at the instant the stretching force being applied to the spring 34 disappears, so in turn the pushing rod 33 will reset the positions of the jaw plate 41 and the eyebrow rod 52 by turning them respectively up and down, as illustrated in FIG. 4, such a simple force transmitting mechanism will enable the mouth (lower jaw part 40) and the eyes (eyebrow part 50) of a Christmas tree to open, close and blink with the rhythm of the Christmas carols, moreover, the flashing of the LED 55 in the eyeballs 51 will constitute an image of Santa Claus singing Christmas carols with his mouth opening and closing, and his eyes blinking and flashing, and all those fun-inducing effects.

In addition to the above, the structural design of this invention also includes the following advancement of practical functions:

1. Simplified integral construction, reasonable and complete design of all components, effective transmission of force, easy assembling, high production efficiency, and the use of only one motor, hence significant reduction of material and working costs, as well as upgraded product competitiveness.
2. Due to the employment of only one set of motor and transmission device, it will effectively save power energy. This invention will have a more durable application efficiency than conventional type of similar products, it will be more economically efficient to the consumers.
3. Simplified transmission mechanism, low consumption of power, effective transmission of force, low trouble rate, and extended service life.

Summing up, with its delicate and complete structural design, this invention will not only improve on the shortcomings of conventional types of similar Christmas tree novelty product, it will also achieve the aforementioned practical functional advancements, therefore, with its novelty, improvement and industrial applicability, this application is duly filed for a patent.

Figure 1:
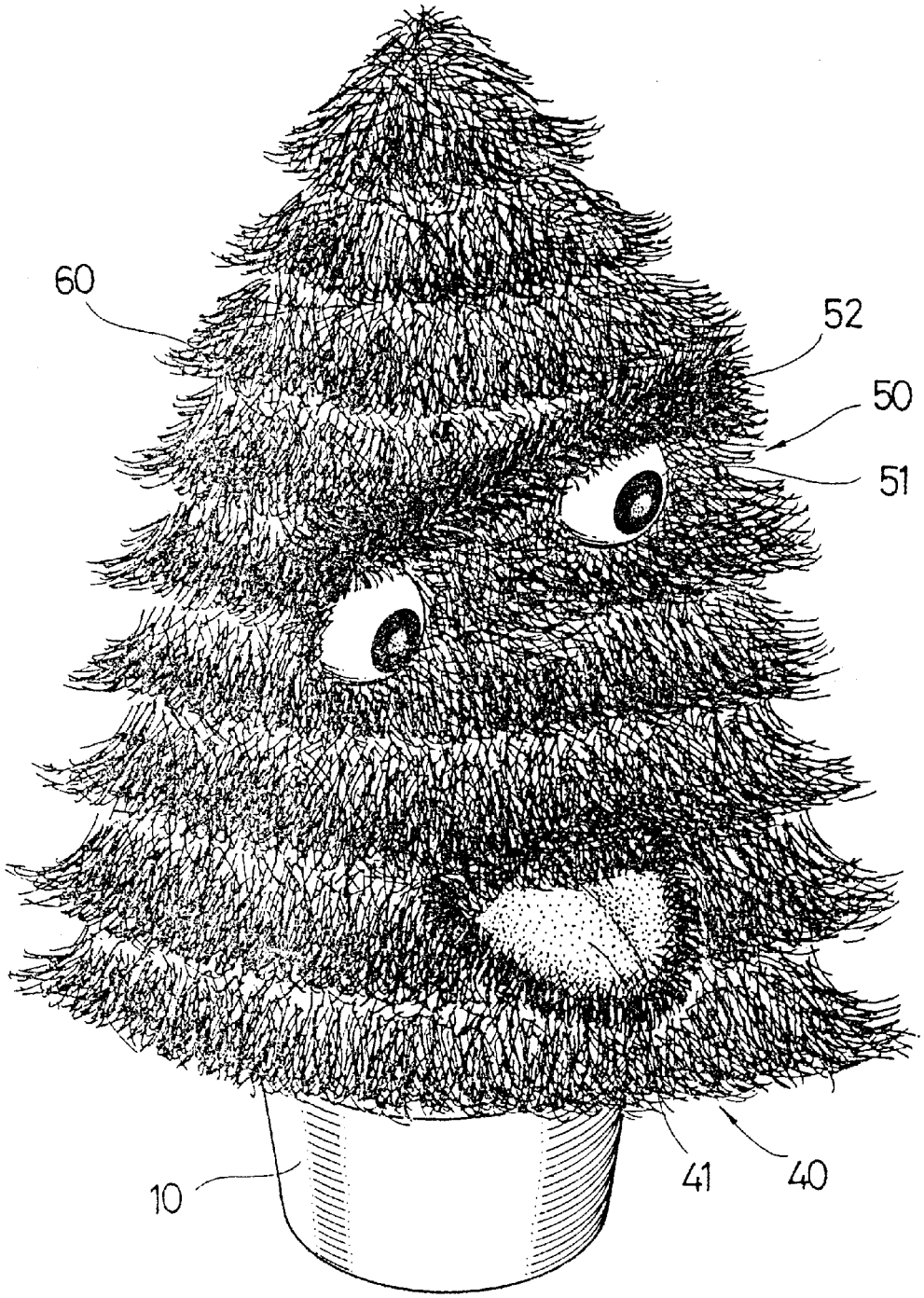
FIG. 1 is an exterior view of this invention.
Figure 2:
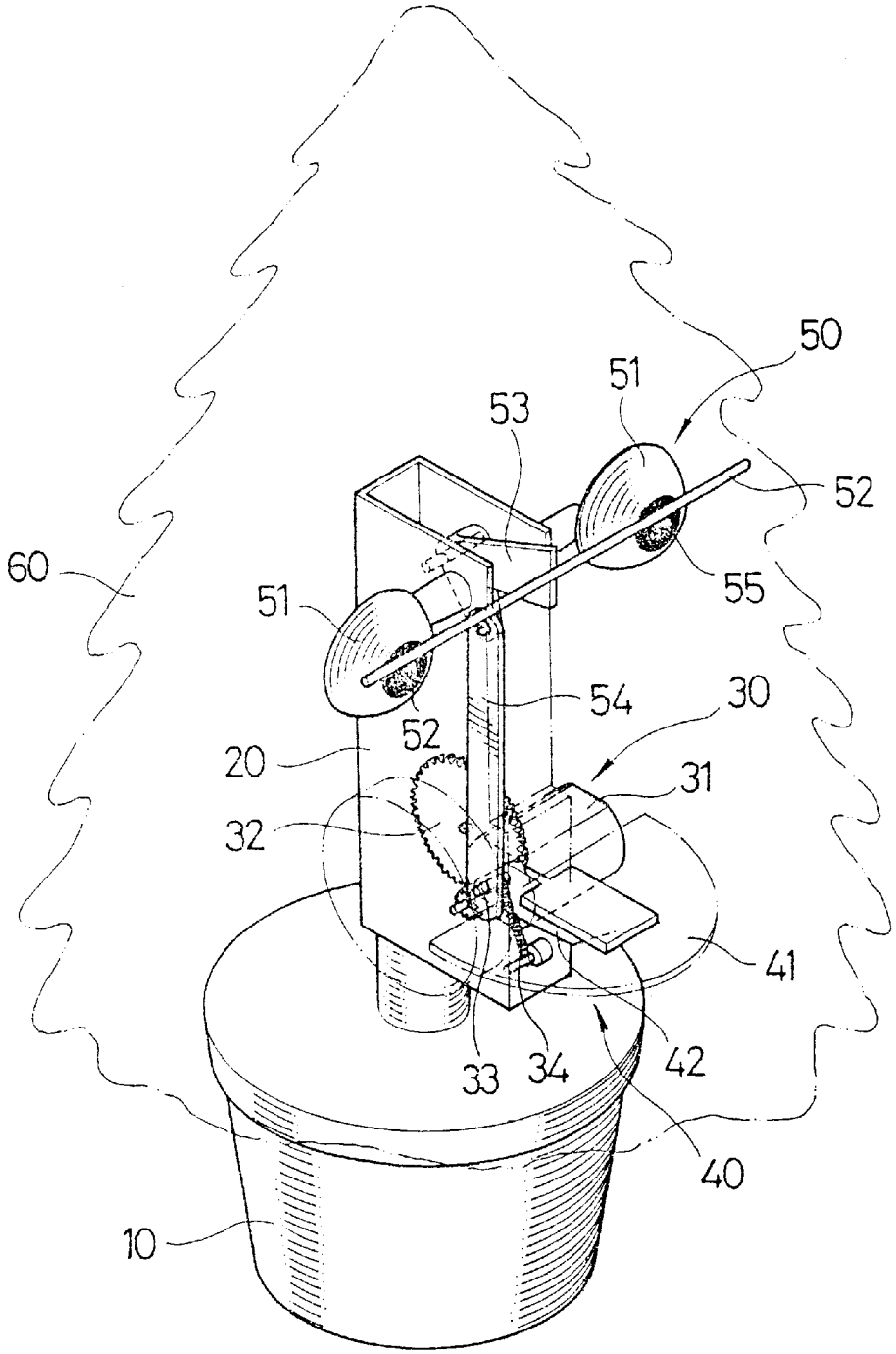
FIG. 2 is a structural view of this invention.
Figure 3:
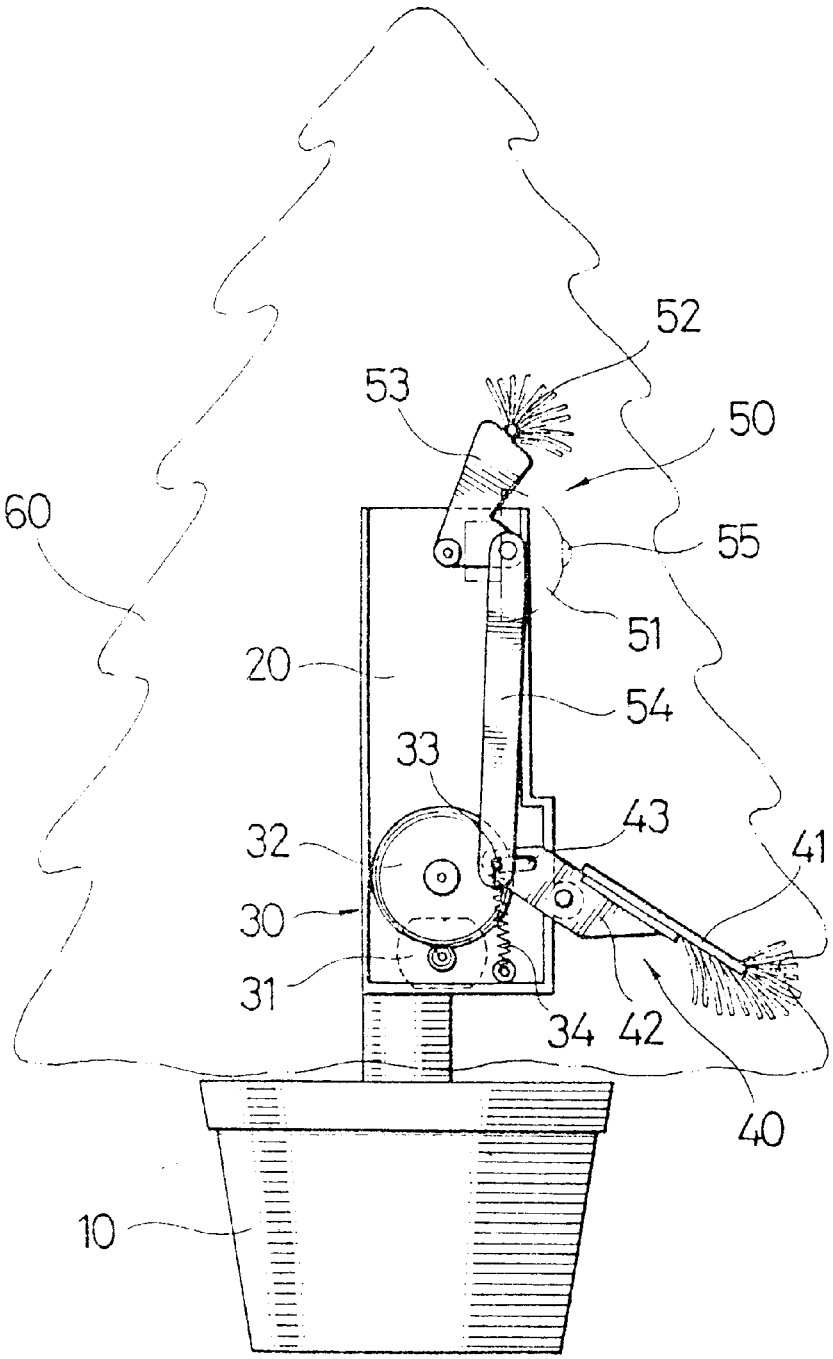
FIG. 3 is a structural view of lower jaw part and eyebrow part in this invention in an opened mode.
Figure 4:
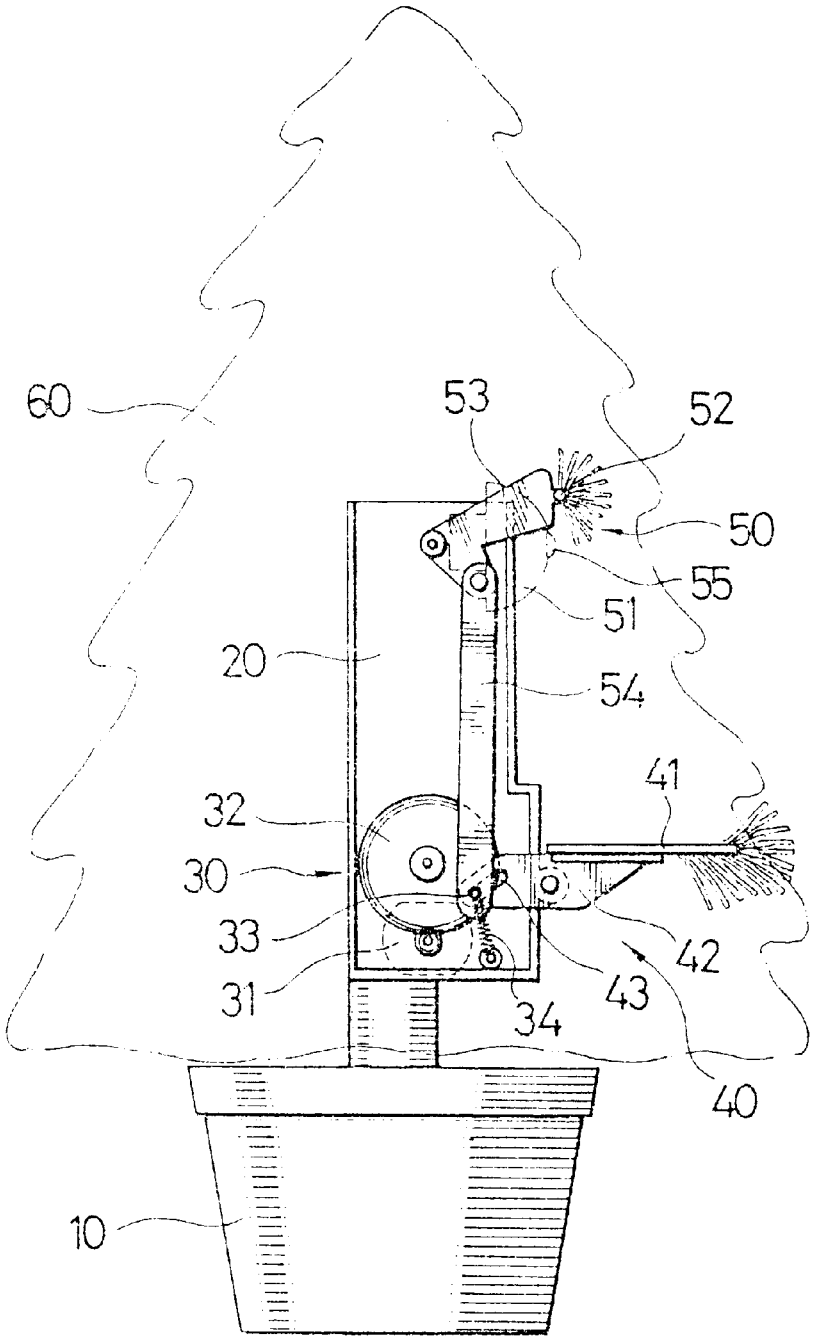
FIG. 4 is a structural view of lower jaw part and eyebrow part in this invention in a closed mode.

Annex 1: Photocopy of data of Patent No. 316488 announced in Patent Gazette in Taiwan

10 base
20 foundation unit
30 transmission device
31 motor
32 reduction gear
33 pushing rod
34 spring
40 lower jaw part
41 jaw plate
42 support plate
43 slide channel
50 eyebrow part
51 eyeball
52 eyebrow rod
53 L-plate
54 driving rod
55 LED
60 branches and leaves

What is claimed is:

1. A toy Christmas tree, comprising:

a base having an interior portion;

a foundation unit installed on top of said base;

branches disposed on an outside of said foundation unit to simulate an exterior appearance of a Christmas tree;

a power source disposed inside said base;

a control circuit board coupled to said power source and having a control circuit;

a transmission device installed at a lower part of said foundation unit, said transmission device including:

a motor coupled to said control circuit board, said control circuit causing said motor to intermittently switch on and off, said motor being fixed to one side of the lower part of said foundation unit, said motor having a rotatable shaft that is intermittently caused to rotate as said motor is intermittently switched on and off, said shaft having teeth;

a reduction gear in engagement with the teeth of said shaft, and being rotatably driven by said shaft as said shaft rotates;

a pushing rod eccentrically located on a side of said reduction gear, said pushing rod being caused to move as said reduction gear is rotated; and a spring linked to said pushing rod, said spring being stretched when said motor is switched on and said reduction gear is rotated in a first direction, said spring retracting when said motor is switched off thereby causing said reduction gear to rotate in a second direction that is opposite to the first direction;

a lower jaw part located at a front of the lower part of the foundation unit, and including:

a jaw plate extending away from the foundation unit; and a support plate disposed at a bottom of the jaw plate, said support plate having a middle section serving as a hinge, the jaw plate being attached to a top of said support plate in front of the hinge, said support plate having a slide channel disposed at a rear of the hinge, said slide channel being penetrated by said pushing rod; and an eyebrow part located at the front of an upper part of the foundation unit, and including:

two eyeballs respectively fitted to two sides of the foundation unit;

an eyebrow rod;

an L-plate pivotally connected to the front of the upper part of the foundation unit, said eyebrow rod being connected to a front end of the L-plate; and a driving rod linking a rear end of said L-plate to said pushing rod, said driving rod being driven by said pushing rod as said reduction gear is rotated;

wherein the on-and-off rotation of the motor is controlled by pulses emitted by the control circuit board, so by means of the rotation of the pushing rod via the reduction gear and the stretching and retracting of the spring, the jaw plate and the eyebrow rod will be intermittently driven to move up and down.

2. The toy Christmas tree recited in claim 1, wherein the outside of the foundation unit, an edge of the jaw plate, and the eyebrow rod have branches and leaves adhered thereto to simulate the exterior appearance of the Christmas tree.

3. The toy Christmas tree recited in claim 1, wherein said power source comprises a plurality of batteries installed within said base.

4. The toy Christmas tree recited in claim 1, wherein said base further includes a power switch coupled to said batteries for supplying power to said control circuit board and said motor.

* * * * *